US008583298B2

(12) United States Patent
Tomioka et al.

(10) Patent No.: US 8,583,298 B2
(45) Date of Patent: Nov. 12, 2013

(54) SIGNAL SYSTEM ON RAILWAY VEHICLE, RAILWAY TRANSPORTATION SYSTEM AND RAILWAY VEHICLE

(75) Inventors: Naoya Tomioka, Hitachi (JP); Koushirou Sakado, Hitachinaka (JP); Morimitsu Kubo, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 321 days.

(21) Appl. No.: 12/974,308

(22) Filed: Dec. 21, 2010

(65) Prior Publication Data

US 2011/0160942 A1 Jun. 30, 2011

(30) Foreign Application Priority Data

Dec. 25, 2009 (JP) ..... 2009-293703

(51) Int. Cl.
*G05D 1/00* (2006.01)

(52) U.S. Cl.
USPC ..... 701/19; 701/36; 340/992; 246/187 C

(58) Field of Classification Search
USPC ..... 246/187 C, 186; 701/19, 36, 1, 2; 340/992, 993; 370/328, 337, 346, 349
See application file for complete search history.

(56) References Cited

U.S. PATENT DOCUMENTS

2003/0151520 A1 * 8/2003 Kraeling et al. ..... 340/825.72

FOREIGN PATENT DOCUMENTS

JP 2001-199336 7/2001
JP 2001199336 A * 7/2001

* cited by examiner

*Primary Examiner* — Thomas Tarcza
*Assistant Examiner* — Adam Tissot
(74) *Attorney, Agent, or Firm* — Antonelli, Terry, Stout & Kraus, LLP.

(57) ABSTRACT

The invention solves the prior art problem of signals not being transmitted between ground and vehicle when a train stops so that a cross point of a loop coil or a boundary between two loop coils is positioned between antennas disposed on a front side and a rear side in a direction of travel of the train. The present invention provides an arrangement in which two or more antennas are disposed on a front side and a rear side in the direction of travel of the train and providing a difference in signal levels received via the respective antennas, so that even when the train stops with the cross point of the loop coil positioned between antennas disposed on the front side and the rear side in the direction of travel of the train and the signals received via the front-side antenna becomes reverse phase with the signals received via the rear-side antenna and the signals are cancelled out, the signals having a higher reception level remains without being cancelled out, and therefore, a given level of transmission and reception can be obtained.

9 Claims, 11 Drawing Sheets

SIGNAL SYSTEM ON RAILWAY VEHICLE, RAILWAY TRANSPORTATION SYSTEM AND RAILWAY VEHICLE

The present application is based on and claims priority of Japanese patent application No. 2009-293703 filed on Dec. 25, 2009, the entire contents of which are hereby incorporated by reference.

BACKGROUND OF THE INVENTION

1. Field of the Invention

The present invention relates to a system for transmitting and receiving train control signals using loop coils.

2. Description of the Related Art

FIG. 8 shows a state where four antennas A disposed on a train 1 at locations other than a cross point 3 are transmitting and receiving ground signals and on-vehicle signals when given ground signals are applied to a loop coil 2 from a trackside transceiver 4.

In the description, the cross point 3 refers to a crossing point of a loop coil disposed to solve the imbalance of inductance and capacitance of the loop coil.

Ground signals output from the trackside transceiver 4 are applied to the loop coil 2, and the loop coil 2 generates a magnetic field by the current components of the ground signals.

The antennas A disposed on the train 1 receive the magnetic field generated from the loop coil 2 via a magnetic coupling and transmit the ground signals to an on-vehicle transceiver 6 disposed on the train 1.

Further, the antennas A disposed on the train 1 generate a magnetic field by the current components of the on-vehicle signals output from the on-vehicle transceiver 6 and transmit the on-vehicle signals via the magnetic coupling to a trackside receiver 5.

The train 1 is controlled via the ground signals received from the antennas A. Further, train detection is performed based on the on-vehicle signals transmitted from the antennas A.

Since the principle of operation of the antenna A disposed on the train 1 for receiving ground signals is the same as the principle of operation of the antenna A for sending on-vehicle signals, only the operation of the antenna A for receiving ground signals will be described.

Both the antennas A disposed on the front side in the direction of travel of the train 1 and the antennas A disposed on the rear side in the direction of travel of the train 1 receive the magnetic field induced from the opposing loop coil 2 via the magnetic coupling. The four antennas A disposed on the train 1 have current components of the ground signals of the same level induced in the same direction. Since the antennas A disposed on the train 1 are series-connected to add the levels, the on-vehicle transceiver 6 receives transmission of the added ground signals received via the antennas A. When assuming that the level of ground signals received via the two antennas A disposed on the front side in the direction of travel of the train 1 is "1" and the level of ground signals received via the two antennas A disposed on the rear side in the direction of travel of the train 1 is "1", the ground signals transmitted to the on-vehicle transceiver 6 will be "1"+"1"="2".

However, as shown in FIG. 9, when the train 1 stops so that the cross point 3 of the loop coil 2 is positioned between the two antennas A disposed on the front side in the direction of travel of the train 1 and the two antennas A disposed on the rear side in the direction of travel of the train 1, the current components of the ground signals flown through the loop coil 2 opposed to the two antennas A disposed on the front side in the direction of travel of the train 1 will be of reverse phase with the current components of the ground signals flown through the loop coil 2 opposed to the two antennas A disposed on the rear side in the direction of travel of the train 1. Since the direction of flow of the current components of the ground signals is reversed, the current component of the ground signals induced to the antennas A disposed on the front side in the direction of travel of the train 1 will be of reverse phase with the current component of the ground signals induced to the antennas A disposed on the rear side in the direction of travel of the train 1. Since the respective antennas A are series-connected to add the levels, the received ground signals will be of reverse phase and are cancelled out, so that no ground signals are transmitted to the on-vehicle transceiver 6. When assuming that the level of ground signals received via the two antennas A disposed on the front side in the direction of travel of the train 1 is "1", the level of ground signals received via the two antennas A disposed on the rear side in the direction of travel of the train 1 will be of reverse phase from the ground signals received via the antennas A disposed on the front side, and will be "−1". Since the respective antennas A are series-connected to add the levels, the ground signals transmitted to the on-vehicle transceiver 6 will be "1"+"−1"="0", according to which signals cannot be transmitted between the ground and the vehicle. When the ground signals applied to the loop coils 2 cannot be received, the train cannot continue operation.

Similarly, as shown in FIG. 10, when the train stops so that the boundary between two loop coils 2 to which ground signals of the same frequency and the same level are applied is positioned between the two antennas A disposed on the front side in the direction of travel of the train 1 and the two antennas A disposed on the rear side in the direction of travel of the train 1, the current component of the ground signals flown through the loop coil 2 opposed to the two antennas A disposed on the front side in the direction of travel of the train 1 will be of reverse phase with the direction of the current component of the ground signals flown through the loop coil 2 opposed to the two antennas A disposed on the rear side in the direction of travel of the train 1. Therefore, the current component of ground signals induced to the antennas A disposed on the front side in the direction of travel of the train 1 will be of reverse phase with the current component of the ground signals induced to the antennas A disposed on the rear side in the direction of travel of the train 1 and are cancelled out, so that no ground signals will be transmitted to the on-vehicle transceiver 6.

Japanese patent application laid-open publication No. 2001-199336 (patent document 1) discloses a known art for overcoming the aforementioned prior art problems, wherein when a train 1 stops above a cross point 3, the polarity of one antenna A out of the four antennas A disposed on the train is switched to achieve a given reception level, and when the traveling speed of the train 1 exceeds a predetermined speed, the switching is performed again so that the polarity of the four antennas become additive polarity.

According to a prior art on-vehicle transceiver device, when the train stops so that the cross point of the loop coil is positioned between antennas disposed on the front side in the direction of travel of the train and the antennas disposed on the rear side in the direction of travel of the train, the signals received via the antennas disposed on the front side in the direction of travel of the train will be of reverse phase with the signals received via the antennas disposed on the rear side in the direction of travel of the train and are cancelled out, so that it becomes impossible to transmit signals between the ground and the vehicle.

Further, when the train stops so that the boundary between two loop coils to which signals of the same frequency and the same level are applied is positioned between the antennas disposed on the front side in the direction of travel of the train and the antennas disposed on the rear side thereof, the signals received via the antennas disposed on the front side in the direction of travel of the train will be of reverse phase with the signals received via the antennas disposed on the rear side thereof and are cancelled out, so that it becomes impossible to transmit signals between the ground and the vehicle.

Not only an on-train transceiver device in which a plurality of antennas are disposed on the front and rear side in the direction of travel of the train but also an on-train transceiver for receiving ground signals via a single antenna has the aforementioned problems in that the signals cannot be transmitted between the ground and the train when the cross point of a loop coil or a boundary between two loop coils is positioned at the center of the antenna.

According further to the method disclosed in patent document 1, if the contact point for switching the polarity of antenna A malfunctions, it becomes impossible to transmit signals between the ground and the vehicle when the train stops above the cross point, according to which the train cannot continue operation.

SUMMARY OF THE INVENTION

The present invention aims at solving the problems of the prior art by providing a method for arranging antennas capable of continuing signal transmission between the ground and the vehicle in a stable manner even if the train stops so that the cross point of a loop coil or the boundary between two loop coils to which the signals having the same frequency and same level are applied is positioned between the antenna disposed on the front side in the direction of travel of the train and the antenna disposed on the rear side in the direction of travel of the train.

The signal system on a railway vehicle according to the present invention comprises a first antenna for receiving ground signals from a loop coil, and a second antenna disposed rearward from the first antenna in a direction of travel of the railway vehicle for receiving ground signals from the loop coil, wherein the first antenna and the second antenna are mutually connected to transmit the ground signals to the on-rain receiver, and the first antenna has a receiver sensitivity for receiving signals from the loop coil that differs from the second antenna.

According to another aspect of the present invention, the signal system on a railway vehicle comprises a first antenna for receiving ground signals from the loop coil and transmitting the ground signals to the on-vehicle receiver, and a second antenna disposed rearward from the first antenna in a direction of travel of the railway vehicle for receiving ground signals from the loop coil and transmitting the ground signals to the on-vehicle receiver, wherein the on-vehicle receiver performs a process to change a signal level of the ground signals received from the first antenna or the second antenna so as to differentiate the signal levels of the ground signals received from the first antenna and the ground signals received from the second antenna.

According to yet another aspect of the present invention, the signal system on a railway vehicle comprises a first antenna for receiving ground signals from the loop coil, and a second antenna disposed rearward from the first antenna in a direction of travel of the railway vehicle for receiving ground signals from the loop coil, wherein the first antenna and the second antenna is equipped with two or more coils, the system further comprises a main antenna circuit in which one coil of the first antenna is connected with one coil of the second antenna, and an auxiliary antenna circuit in which the other coil of the first antenna is connected with the other coil of the second antenna, wherein the respective coils of the first antenna and the second antenna have different receiver sensitivity in at least either the main antenna circuit or the auxiliary antenna circuit, and the on-vehicle receiver is equipped with a means for selecting the ground signals used for controlling the vehicle from the ground signals received via the main antenna circuit or the ground signals received via the auxiliary antenna circuit.

According further to the present invention, the signal system on a railway vehicle comprises one or more first antennas for receiving ground signals from the loop coil and transmitting the ground signals to the on-vehicle receiver, and one or more second antennas disposed rearward than the first antenna in the direction of travel of the vehicle for receiving ground signals from the loop coil and transmitting the ground signals to the on-vehicle receiver, wherein the first antenna and the second antenna are mutually connected, and the number of the first antennas differs from the number of the second antennas.

The present invention enables to continue transmission of signals between the loop coil and the vehicle in a more stable manner.

DETAILED DESCRIPTION OF THE PREFERRED EMBODIMENTS

Figure 7:
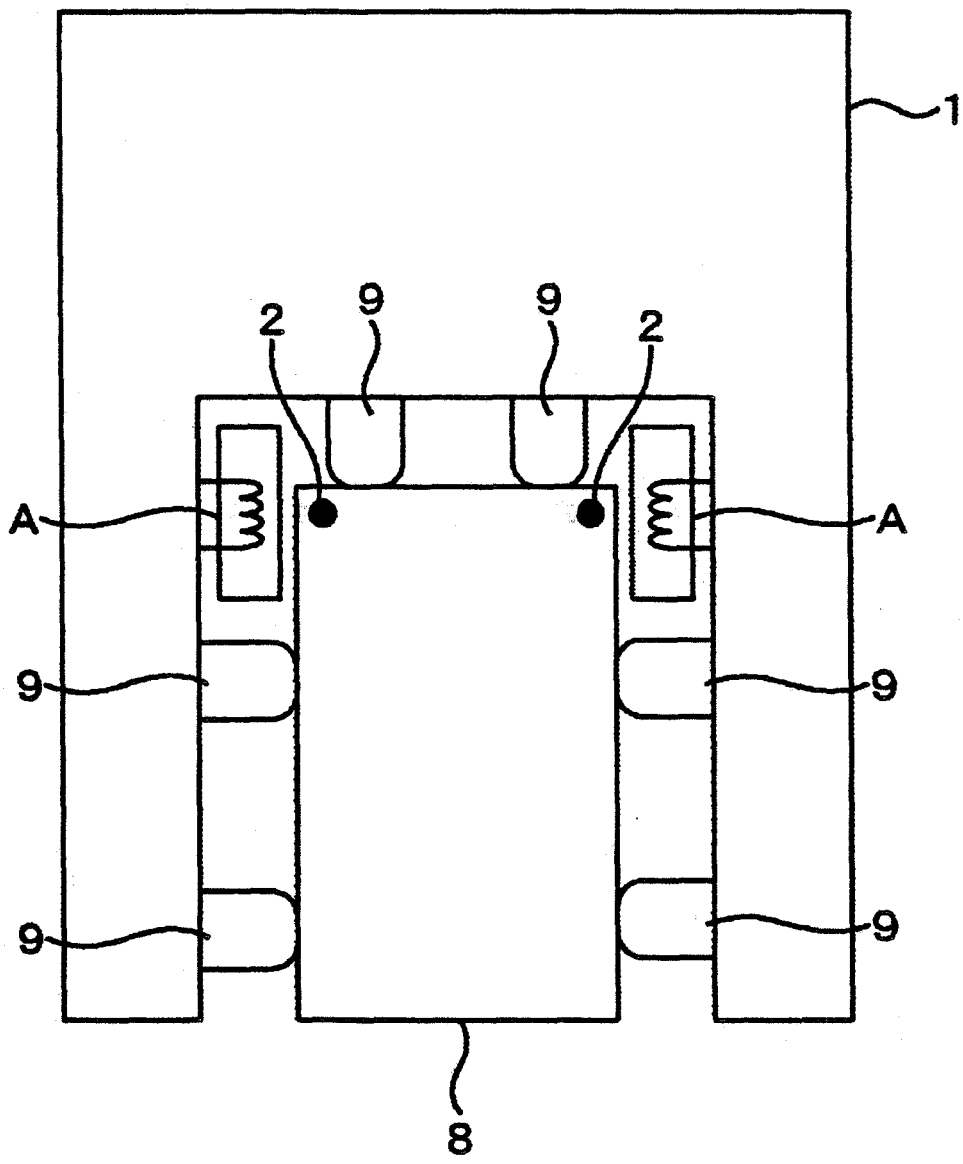
FIG. 7 is a front view showing a train and a trackside equipment according to the present invention.
Figure 8:
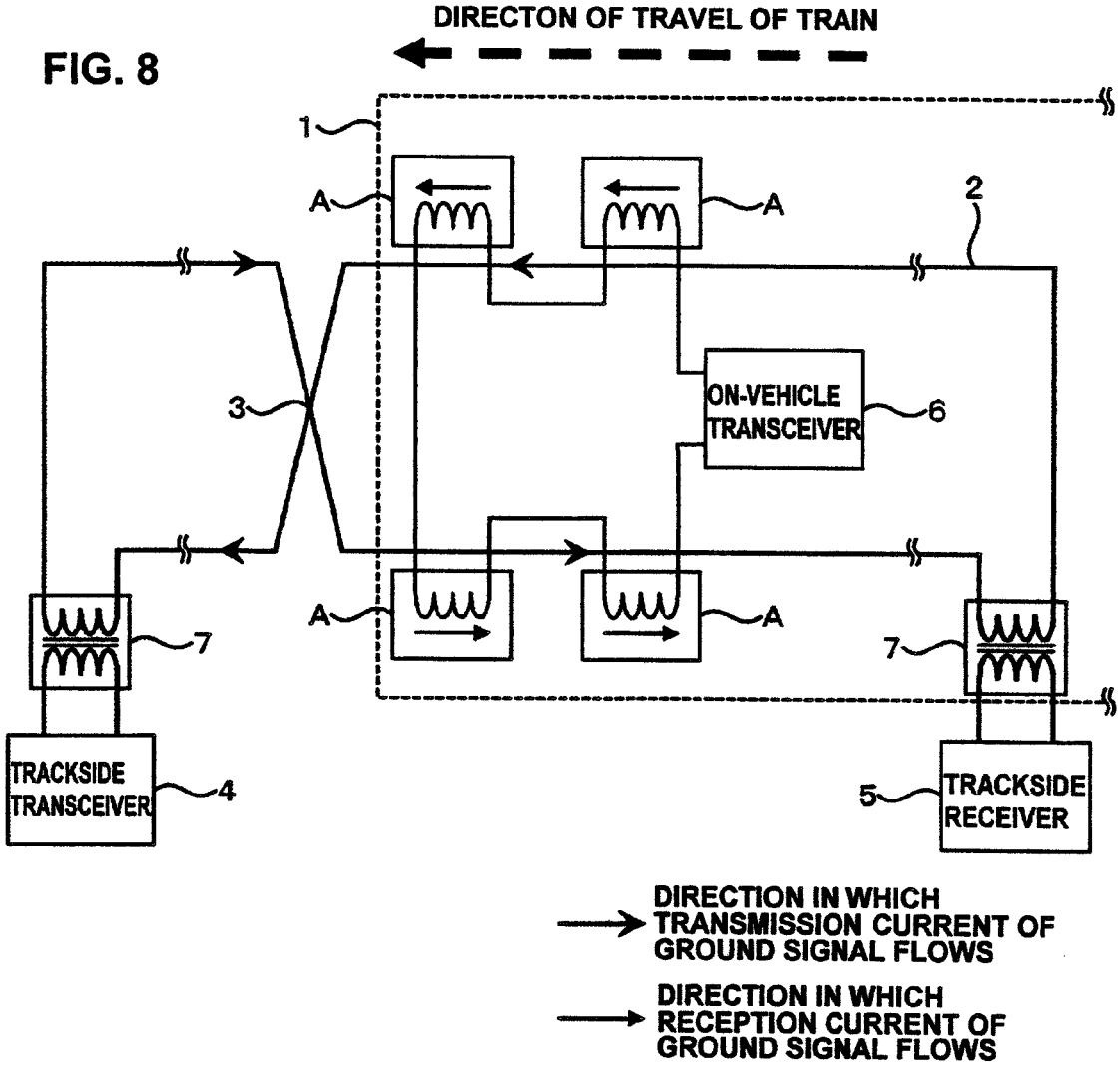
FIG. 8 is an explanatory view of a prior art system.
Figure 9:
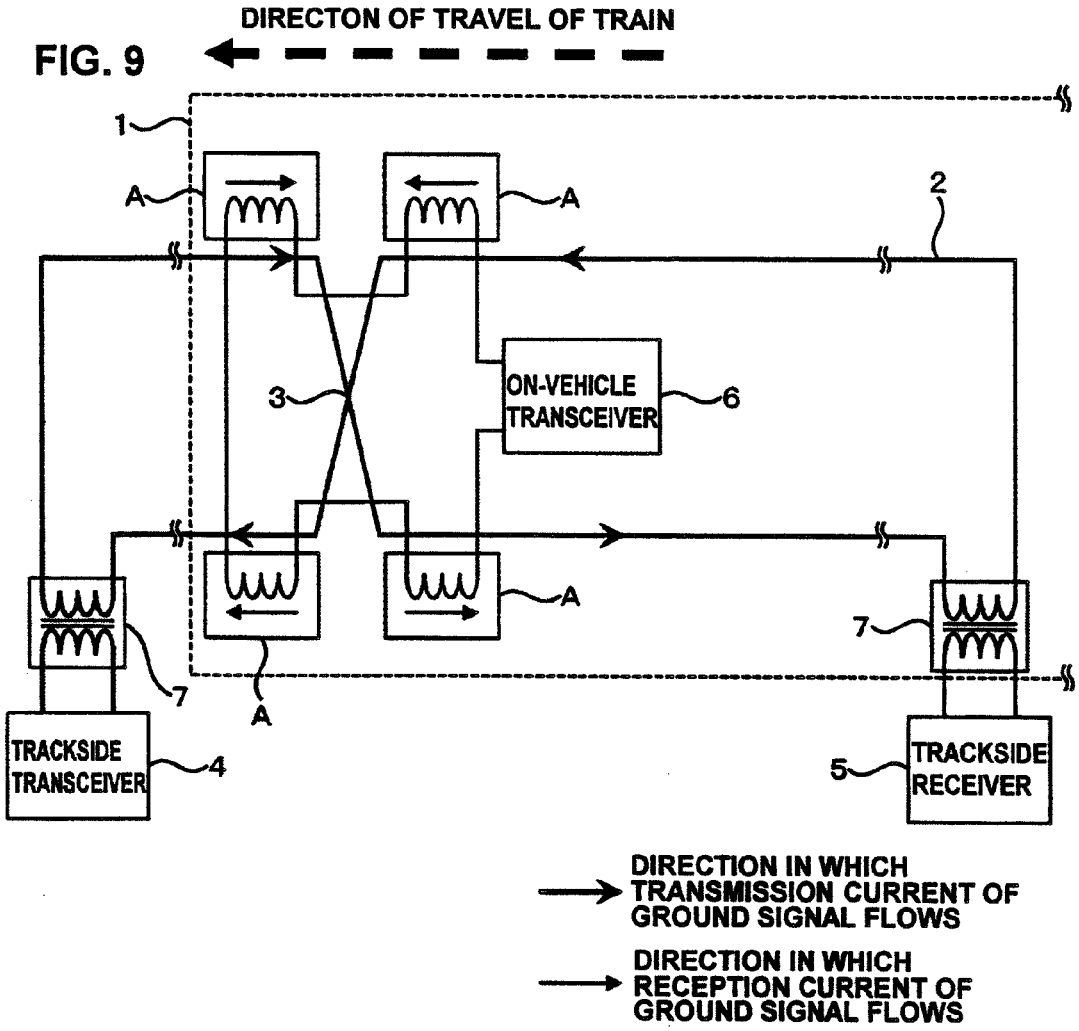
FIG. 9 is an explanatory view of a prior art system.
Figure 10:
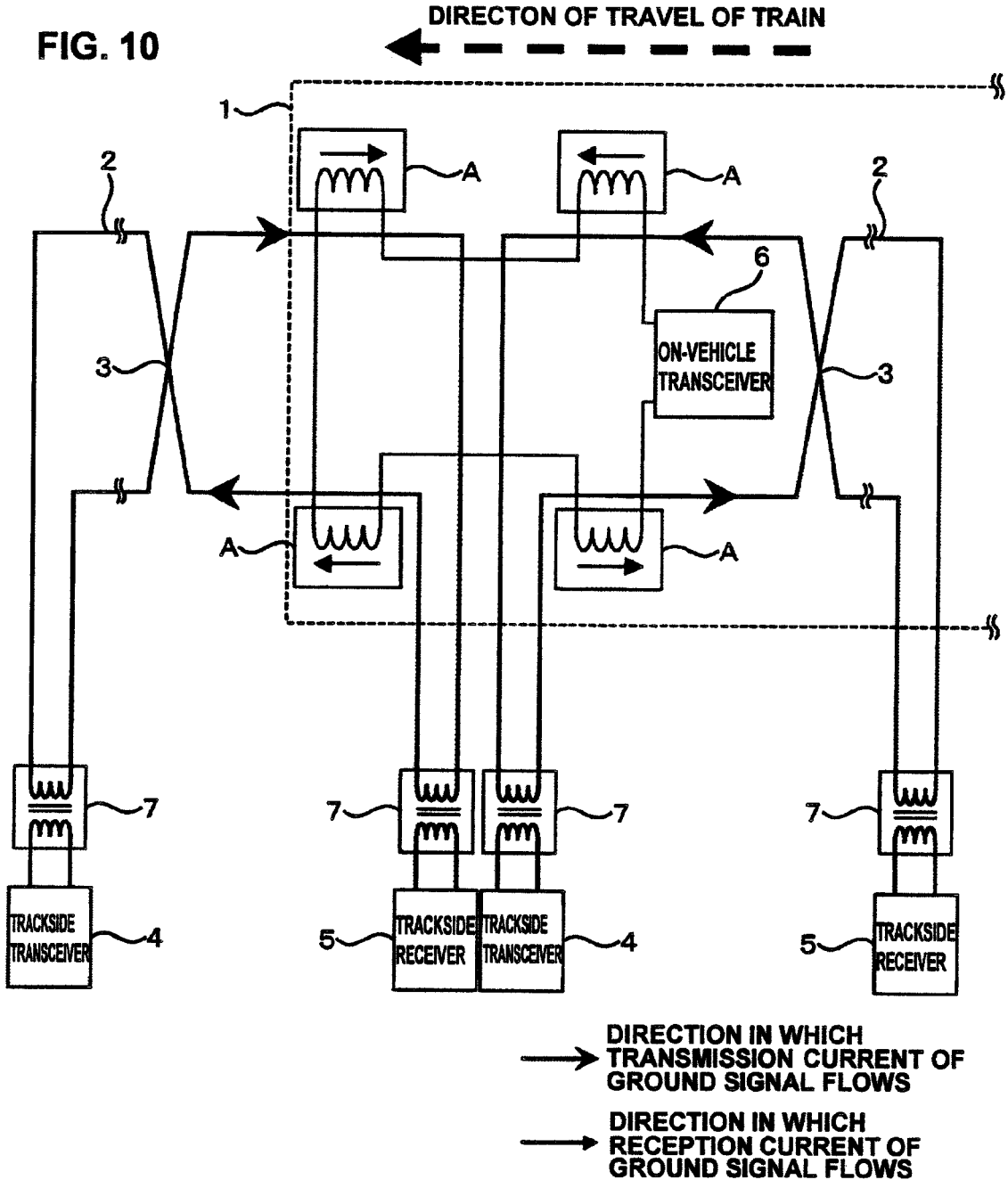
FIG. 10 is an explanatory view of a prior art system.

FIG. 7 is a front view of a train 1 of a straddle-beam monorail and a trackside equipment 8 according to the present invention. The train 1 is disposed on the trackside equipment 8 and designed to run on the trackside equipment 8 via wheels 9.

The train 1 is equipped with two antennas A disposed on the left side and two antennas A disposed on the right side to oppose to loop coils 2 disposed on both side walls of the trackside equipment 8 (two antennas are disposed on one side according to embodiment 1). Antennas A disposed on both left and right sides of the train 1 are series-connected to add the levels.

Ground signals output from a trackside transceiver 4 are applied to the loop coils 2, and the loop coils 2 generate a magnetic field by the current component of the ground signals.

Antennas A disposed on the train 1 receive the magnetic field generated from the loop coils 2 via magnetic coupling, and send the ground signals to an on-vehicle transceiver 6 disposed on the train 1. The train 1 is controlled based on ground signals received via the on-vehicle transceiver 6.

Further, the antennas A disposed on the train 1 generate a magnetic field via the current components of on-vehicle signals output from the on-vehicle transceiver 6, wherein the loop coils 2 receive the magnetic field generated from the antennas A via the magnetic coupling and send on-vehicle signals to the trackside receiver 5. Train detection is performed based on the on-vehicle signals transmitted from antennas A.

Figure 11:
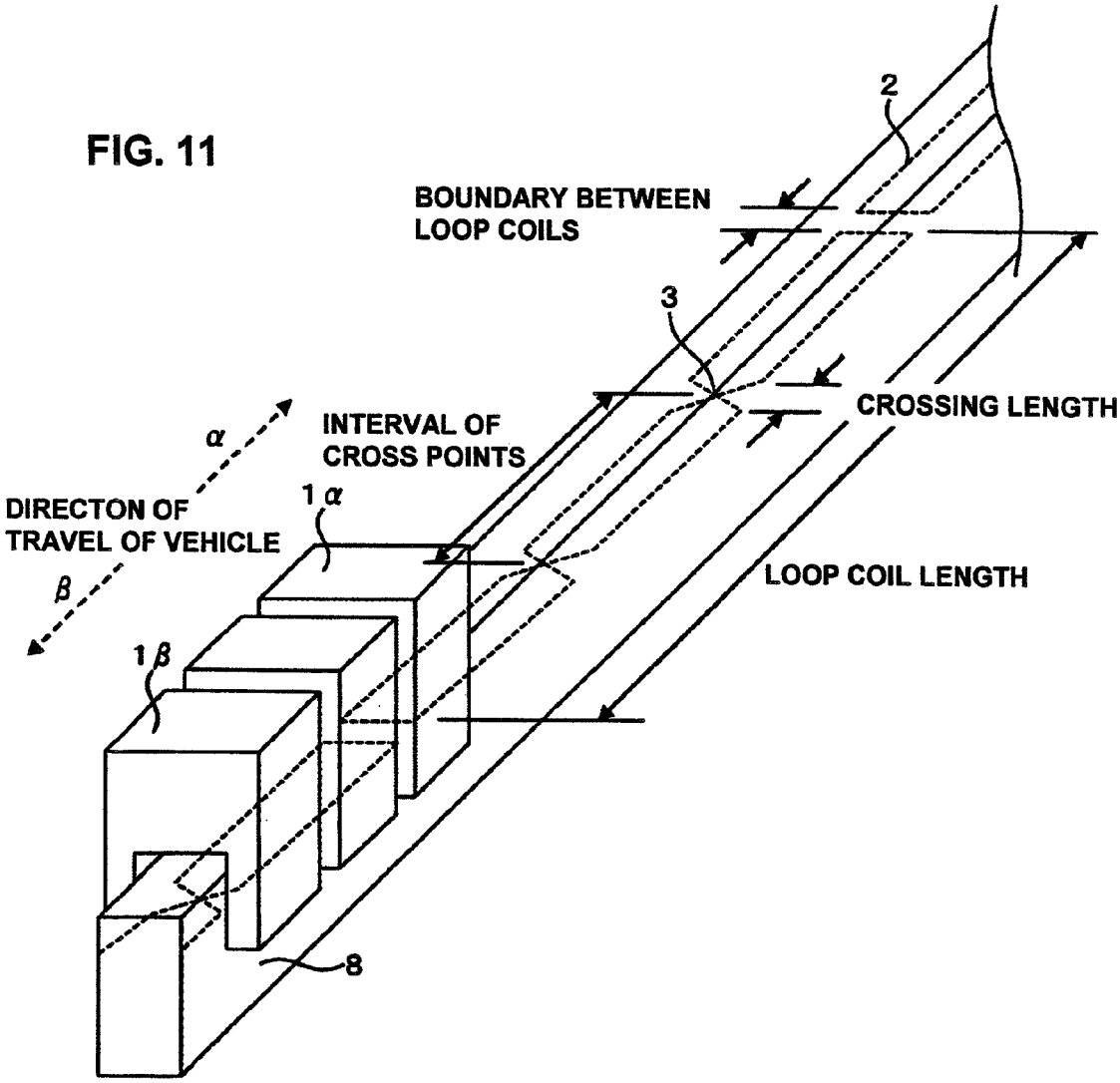
FIG. 11 is a perspective view of a train and a trackside equipment according to the present invention.

FIG. 11 is a perspective view of a train 1 of a straddle-beam monorail and a trackside equipment 8 according to the present invention. For example, the train 1 is formed by connecting three railway vehicles. The on-vehicle transceivers are disposed on cars (1α, 1β) on both ends of the train, and when the railway vehicle 1 travels in a traveling direction α, the on-vehicle transceiver mounted on railway vehicle 1α is used, and when the train turns and travels in a traveling direction β, the on-vehicle transceiver mounted on railway vehicle 1β is used.

Figure 1:
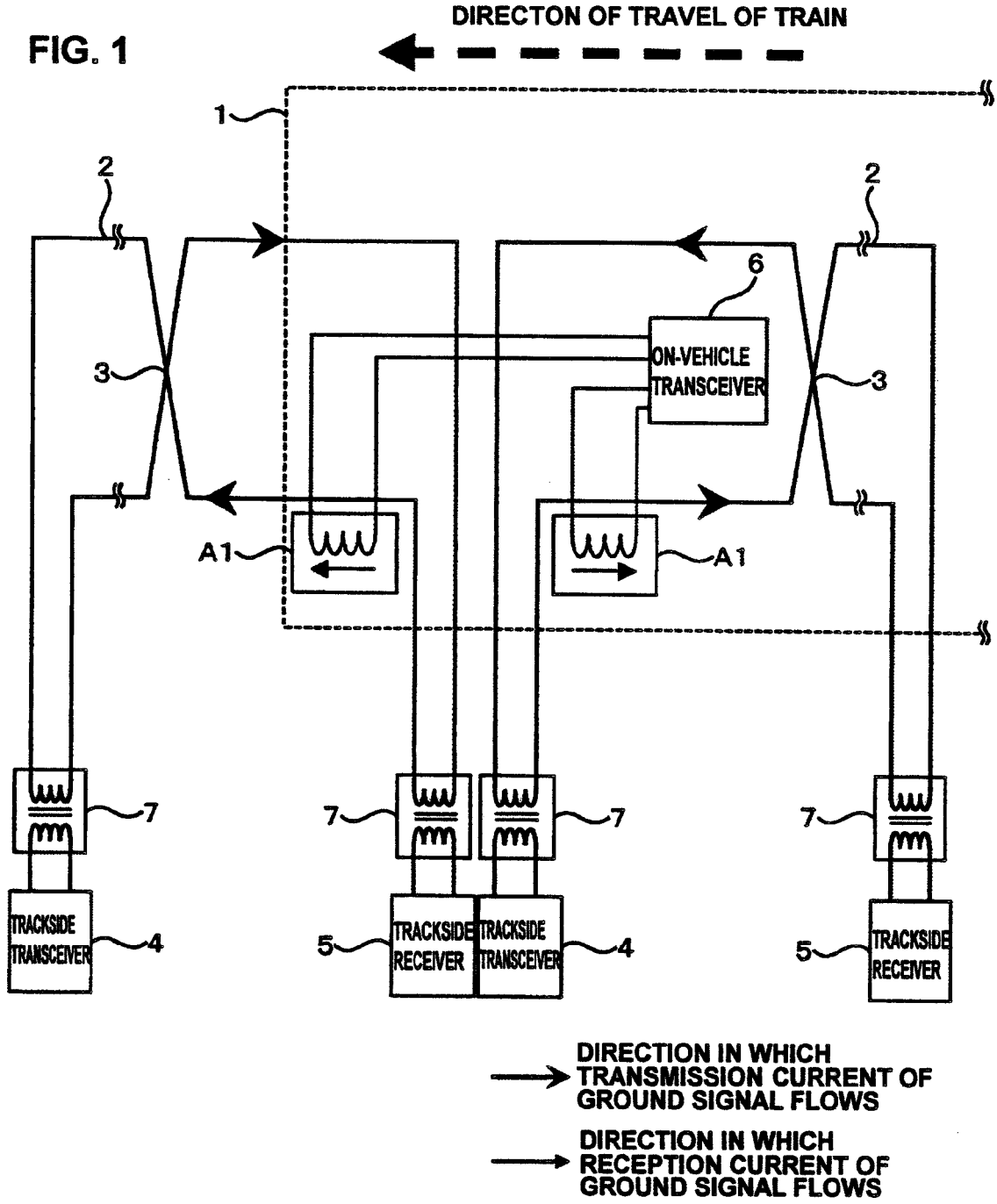
FIG. 1 is an explanatory view showing a first embodiment for carrying out the present invention.

We will now show an example of the actual scale size. The length of a single loop coil 2 on the track is 23 m to 600 m, the interval of cross points is 25 m to 100 m (normally, one or more cross points are formed in a single loop coil), the boundary of loop coils is approximately 200 mm, and the length of a crossing is approximately 30 mm. The boundary of loop coils 2 is shown in a simplified manner in FIG. 11, but actually as shown in FIG. 1, the loop coils are connected via transformers to trackside receivers or trackside transceivers.

Now, we will describe the detailed arrangements of respective embodiments for sending and receiving signals between the loop coils 2 connected to trackside transceiver 4 and trackside receivers 5 and on-vehicle transceivers 6.

Further, the present embodiments refer to an example where the loop coils and the on-vehicle transceivers 6 send and receive signals, but the present invention can be applied to on-board equipments capable of only sending signals or only receiving signals.

[Embodiment 1]

FIG. 1 shows the arrangement and operation of an embodiment in which the present invention is used. FIG. 1 illustrates an example where a train is stopped so that the boundary between two loop coils 2 to which are applied ground signals of the same frequency and the same level is positioned between the antenna A1 disposed on the front side in the direction of travel of the train and the antenna A1 disposed on the rear side in the direction of travel of the train.

Since the principle of operation of the antenna A1 disposed on the train 1 for receiving ground signals is the same as the principle of operation of the antenna A1 for sending on-vehicle signals, only the operation of the antenna A1 for receiving ground signals will be described.

FIG. 1 shows an arrangement in which antennas A1 are respectively disposed on the front side in the direction of travel of the train 1 and on the rear side in the direction of travel of the train 1, wherein the respective antennas A1 are independently connected to the on-vehicle transceiver 6.

Since the antenna A1 disposed on the front side in the direction of travel of the train 1 and the antenna A1 disposed on the rear side in the direction of travel of the train 1 is equipped with coils having the same turns, the levels of the ground signals received by the respective antennas A1 are the same. However, it is possible to provide a level difference to the ground signals received by the antenna A1 disposed on the front side in the direction of travel of the train 1 and the ground signals received by the antenna A1 disposed on the rear side in the direction of travel of the train 1, for example, by doubling the level of ground signals received via the antenna A1 disposed on the front side in the direction of travel of the train 1 while unchanging the level of the ground signals received via the antenna A1 disposed on the rear side in the direction of travel of the train 1, and adding the ground signals received by the respective antennas.

The train 1 cannot continue operation if the ground signals applied to the loop coil 2 disposed on the front side in the direction of travel of the train 1 cannot be received, but by processing the level of ground signals received via the antenna A1 disposed on the front side in the direction of travel of the train 1 to be greater than the level of the ground signals received via the antenna A1 disposed on the rear side in the direction of travel of the train 1 by a process performed in the on-vehicle transceiver 6, it becomes possible to constantly receive ground signals applied to the loop coil 2 disposed on the front side in the direction of travel of the train 1 even when the train 1 stops so that the boundary between two loop coils having ground signals of the same frequency and same level applied thereto is positioned between the front side antenna A1 and the rear side antenna A1 in the direction of travel of the train 1, so that continuous train control becomes possible. The difference between levels of ground signals received via the front side antenna A1 and the rear side antenna A1 provided by the process in the on-vehicle transceiver 6 is set to be greater than the signal level capable of performing train control.

Further, as described earlier, by providing a difference in levels of ground signals received via the front side antenna A1 and the rear side antenna A1 via a process performed in the on-vehicle transceiver 6, it becomes possible to obtain a predetermined transmission and reception level even when the train stops so that the cross point 3 of the loop coil 2 is positioned between the front side antenna A1 and the rear side antenna A1 in the direction of travel of the train 1.

The present embodiment provides an arrangement in which the on-vehicle transceiver 6 is capable of receiving ground signals applied to the loop coils 2 continuously without having to switch the polarity of antennas in response to the contact point within the circuit as taught in patent document 1, regardless of whether the boundary of the loop coils 2 or the cross point of the loop coil 2 is positioned between the front side antenna A1 and the rear side antenna A1 or not, so that train control can be performed continuously in a stable manner. The above-described embodiment adopts an arrangement in which one antenna A1 is disposed in the front side and one antenna A1 is disposed in the rear side of the direction of travel of the train as shown in FIG. 1, but the present embodiments can be applied to an example where two series-connected antennas for adding the levels are arranged respectively on the front and rear sides and wherein the front-side and rear-side antennas A1 are independently connected to the on-vehicle transceiver 6.

[Embodiment 2]

Figure 2:
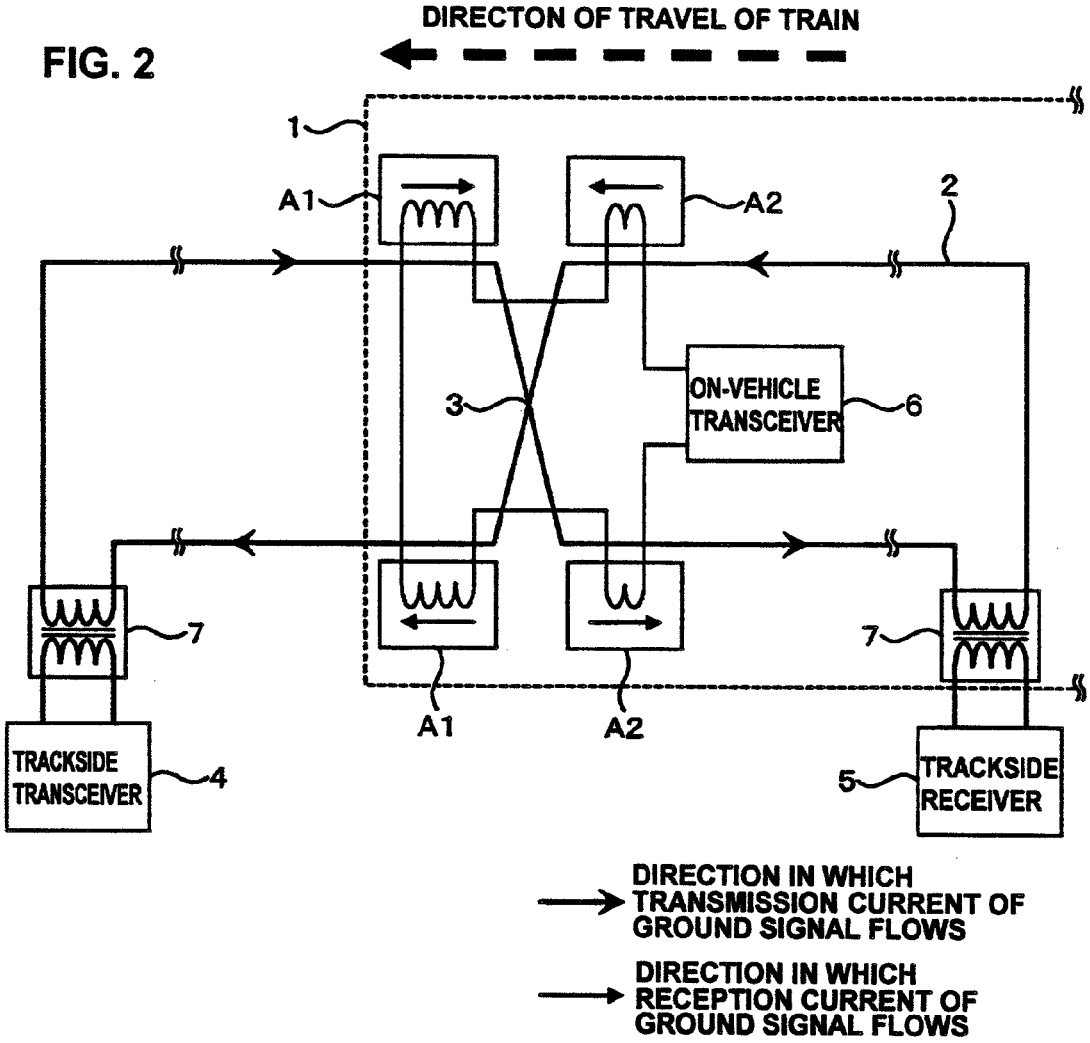
FIG. 2 is an explanatory view showing a second embodiment for carrying out the present invention.

FIG. 2 shows an arrangement and operation of an embodiment for carrying out the present invention. FIG. 2 illustrates an example where a train stops so that a cross point 3 of a loop coil 2 is positioned between the antennas A1 and A2 disposed on the front and rear sides in the direction of travel of the train 1.

Since the principle of operation of the antennas A1 and A2 disposed on the train 1 for receiving ground signals is the same as the principle of operation of the antennas A1 and A2 for sending on-vehicle signals, only the operation of the antennas A1 and A2 for receiving ground signals will be described.

FIG. 2 shows an arrangement in which two antennas A1 having coils with M turns are disposed on the front side in the direction of travel of the train 1 and two antennas A2 having coils with N turns are arranged on the rear side in the direction of travel of the train 1, wherein the respective antennas A1 and A2 are series-connected so as to add the levels. The number of turns M and the number of turns N of the antennas A1 and A2 disposed on the front and rear sides in the direction of travel of the train 1 satisfies a relationship of M>N, for example. The antenna having a coil with a greater number of turns has superior receiver sensitivity, so the receiver sensitivity of the antennas A1 disposed on the front side in the direction of travel of the train 1 is higher than the receiver sensitivity of the antennas A2 disposed on the rear side in the direction of travel of the train 1.

Now, we will describe the operation for receiving ground signals when the train 1 stops so that the cross point 3 of the loop coil 2 is positioned between the antennas A1 disposed on the front side in the direction of travel of the train 1 and the antennas A2 disposed on the rear side in the direction of travel of the train 1.

When the train stops so that the cross point 3 of the loop coil 2 is positioned between the antennas A1 disposed on the front side in the direction of travel of the train 1 and the antennas A2 disposed on the rear side in the direction of travel of the train 1, the current component of the ground signals flowing through the loop coil 2 opposed to the antenna A1 is of reverse phase with the current component of the ground signals flowing through the loop coil 2 opposed to the antenna A2. Since the directions of flow of current components of the ground signals are of reverse phase, the current component of ground signals induced to antennas A1 is of reverse phase with the current component of ground signals induced to antennas A2. Since the respective antennas A1 and A2 are series-connected to add the levels, the ground signals received via the antennas A1 cancel out the ground signals received via the antennas A2.

However, since the number of turns M of the coil of the antennas A1 is greater than the number of turns N of the coil of the antennas A2, the ground signals received via the antennas A1 become greater than the ground signals received via the antennas A2, and even if the current components of ground signals respectively induced to antennas A1 and A2 are of reverse phase, the ground signals received via the antennas A1 with higher level will remain without being cancelled out and are transmitted to the on-vehicle transceiver 6.

When it is assumed that the level of the ground signals received via the antennas A1 is "$I_M$" and the level of the ground signals received via the antennas A2 is "$I_N$", the flow of the current component of ground signals induced to antennas A2 becomes reverse phase with the flow of current component of ground signals induced to antennas A1, so that the level becomes "$-I_N$". Since the respective antennas A1 and A2 are series-connected to add the levels, the on-vehicle transceiver 6 receives transmission of "$I_M$"+"$-I_N$"="$I_N-I_N$" ground signals. Since the number of turns of antennas A1 is greater than the number of turns of antennas A2, the relationship of reception levels "$I_M$" and "$I_N$" of the ground signals satisfies "$I_M$">"$I_N$". Therefore, the ground signals transmitted to the on-vehicle transceiver 6 does not become "0". Further, the ground signals "$I_M-I_N$" transmitted to the on-vehicle transceiver 6 is set to a level high enough to enable train control.

It is assumed in the present description that the receiver sensitivity of antennas A1 disposed on the front side in the direction of travel of the train 1 is higher than the receiver sensitivity of antennas A2 disposed on the rear side in the direction of travel of the train 1, but even if the receiver sensitivity of antennas A2 disposed on the rear side in the direction of travel of the train 1 is set to be higher, the ground signals transmitted to the on-vehicle transceiver 6 will not become "0".

Further according to the present description, four antennas are series-connected to add the levels, but even if an arrangement in which four antennas are connected to subtract the levels and a difference in levels is provided between the ground signals received via antennas A1 disposed on the front side in the direction of travel of the train 1 and the ground signals received via the antennas A2 disposed on the rear side in the direction of travel of the train 1, the ground signals transmitted to the on-vehicle transceiver 6 does not become "0".

According to the present embodiment, the on-vehicle receiver 6 is constantly capable of receiving ground signals regardless of whether or not antennas exist on the cross point 3 of the loop coil 2. In other words, the present embodiment enables to continue signal transmission and reception between the ground and the train without having to switch polarities of the antenna in response to the contact point on the circuit as taught in patent document 1.

[Embodiment 3]

Figure 3:
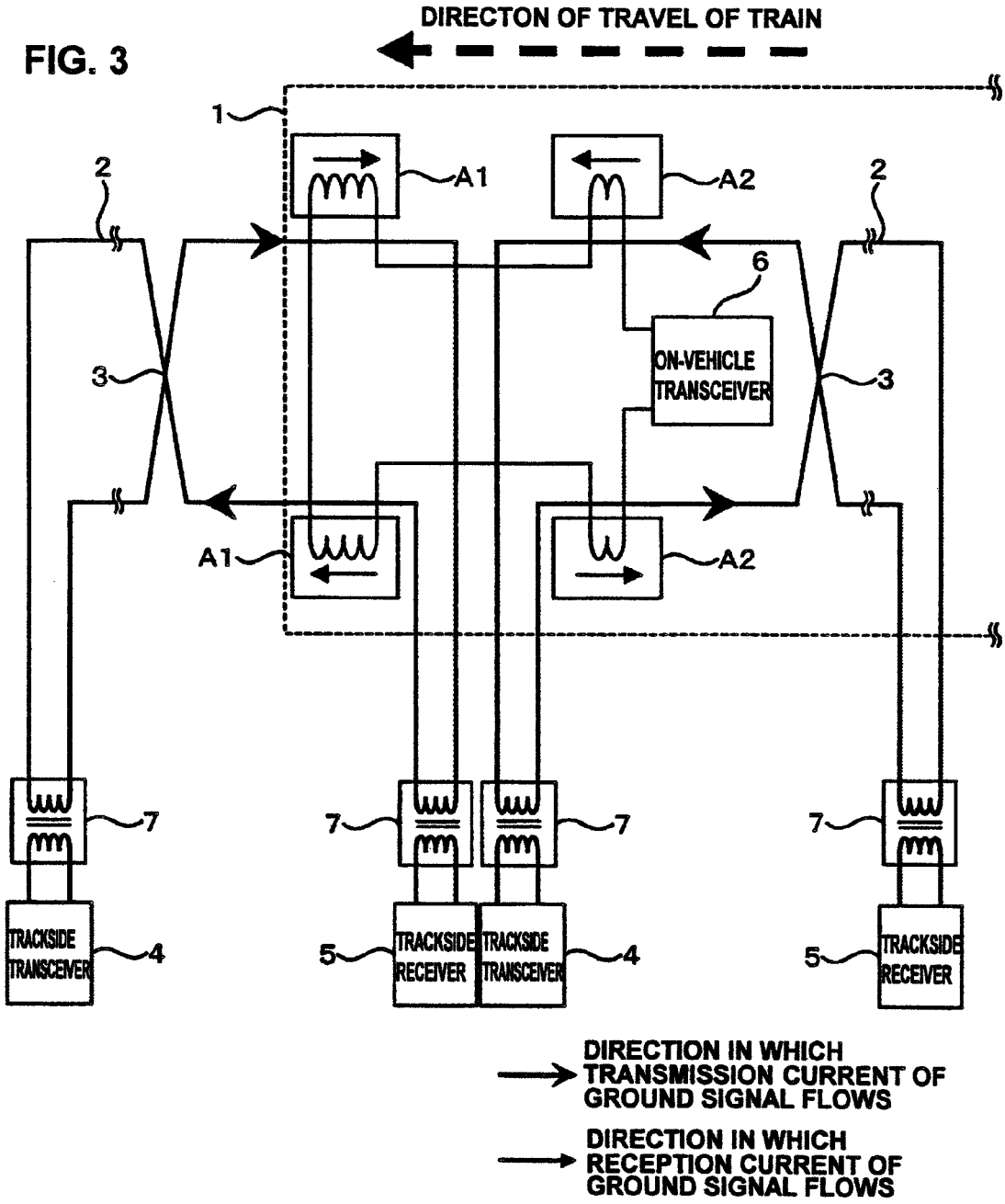
FIG. 3 is an explanatory view showing a third embodiment for carrying out the present invention.

FIG. 3 shows an arrangement and operation of an embodiment for carrying out the present invention. FIG. 3 illustrates an example where a train stops so that the boundary between two loop coils 2 to which are applied ground signals of the same frequency and the same level is positioned between the antennas A1 disposed on the front side in the direction of travel of the train and the antennas A2 disposed on the rear side in the direction of travel of the train.

Since the principle of operation of the antennas A1 and A2 disposed on the train 1 for receiving ground signals is the same as the principle of operation of the antennas A1 and A2 for transmitting on-vehicle signals, only the operation of the antennas A1 and A2 for receiving ground signals will be described.

FIG. 3 shows an arrangement in which two antennas A1 having coils with M turns are disposed on the front side in the direction of travel of the train 1 and two antennas A2 having coils with N turns are arranged on the rear side in the direction of travel of the train 1, wherein the respective antennas A1 and A2 are series-connected to add the levels. The number of turns M and N of antennas A1 and A2 disposed on the front and rear sides in the direction of travel of the train 1 satisfies a relationship of M>N, for example. The antenna having a coil with greater number of turns has superior receiver sensitivity, so the receiver sensitivity of the antennas A1 disposed on the front side in the direction of travel of the train 1 is higher than the receiver sensitivity of the antennas A2 disposed on the front side in the direction of travel of the train 1.

Now, we will describe the operation for receiving ground signals when the train 1 stops so that the boundary between two loop coils to which ground signals having the same frequency and the same level are applied is positioned between the antennas A1 disposed on the front side in the direction of travel of the train 1 and the antennas A2 disposed on the rear side in the direction of travel of the train 1.

When the train stops so that the boundary between two loop coils to which ground signals having the same frequency and the same level are applied is positioned between the antennas A1 disposed on the front side in the direction of travel of the train 1 and the antennas A2 disposed on the rear side in the direction of travel of the train 1, the current component of the ground signals flowing through the loop coil 2 opposed to the antenna A1 is of reverse phase with the current component of the ground signals flowing through the loop coil 2 opposed to the antenna A2. Since the directions of flow of current components of the ground signals are of reverse phase, the current component of ground signals induced to antennas A1 is of reverse phase with the current component of ground signals induced to antennas A2. Since the respective antennas A1 and A2 are series-connected to add the levels, the ground signals received via the antennas A1 and the ground signals received via the antennas A2 are cancelled out.

However, the number of turns M of the coil of the antennas A1 is greater than the number of turns N of the coil of the antennas A2, so that the ground signals received via the antennas A1 become greater than the ground signals received via the antennas A2, and even if the current components of ground signals respectively induced to antennas A1 and A2 are reverse phase, the ground signals received via the antennas A1 with higher level will remain without being cancelled out and are transmitted to the on-vehicle transceiver 6.

When it is assumed that the level of the ground signals received via the antennas A1 is "$I_M$" and the level of the ground signals received via the antennas A2 is "$I_N$", the flow of the current component of ground signals induced to antennas A2 will be of reverse phase with the flow of current component of ground signals induced to antenna A1, so that the level becomes "$-I_N$". Since the respective antennas A1 and A2 are series-connected to add the levels, the on-vehicle transceiver 6 receives transmission of "$I_M$"+"$-I_N$"="$I_N-I_N$" ground signals. Since the number of turns of antennas A1 is greater than the number of turns of antennas A2, the relationship of reception levels "$I_N$" and "$I_N$" of the ground signals satisfies "$I_M$">"$I_N$". Therefore, the on-vehicle transceiver 6 constantly receives transmission of ground signals received via antennas A1 disposed on the front side in the direction of travel of the train 1. Further, the ground signals "$I_N-I_N$" transmitted to the on-vehicle transceiver 6 is set to a level high enough to enable train control.

The train 1 cannot continue operation when the ground signals applied to the loop coils 2 disposed on the front side in the direction of travel of the train cannot be received. Therefore, as shown in the present embodiment, by adopting an arrangement in which the receiver sensitivity of the antennas A1 disposed on the front side in the direction of travel of the train 1 is higher, the ground signals applied to the loop coils 2 disposed on the front side in the direction of travel of the train 1 can be received constantly, and the signal information on the front side in the direction of travel of the train can be confirmed on the train, according to which train control can be continued in a stable manner.

According to the present embodiment, the on-vehicle receiver 6 is constantly capable of receiving ground signals regardless of whether or not antennas exist in the boundary between two loop coils. In other words, the present embodiment enables to continue signal transmission and reception between the ground and the train without having to switch polarities of the antenna in response to the contact point on the circuit as taught in patent document 1.

[Embodiment 4]

Figure 4:
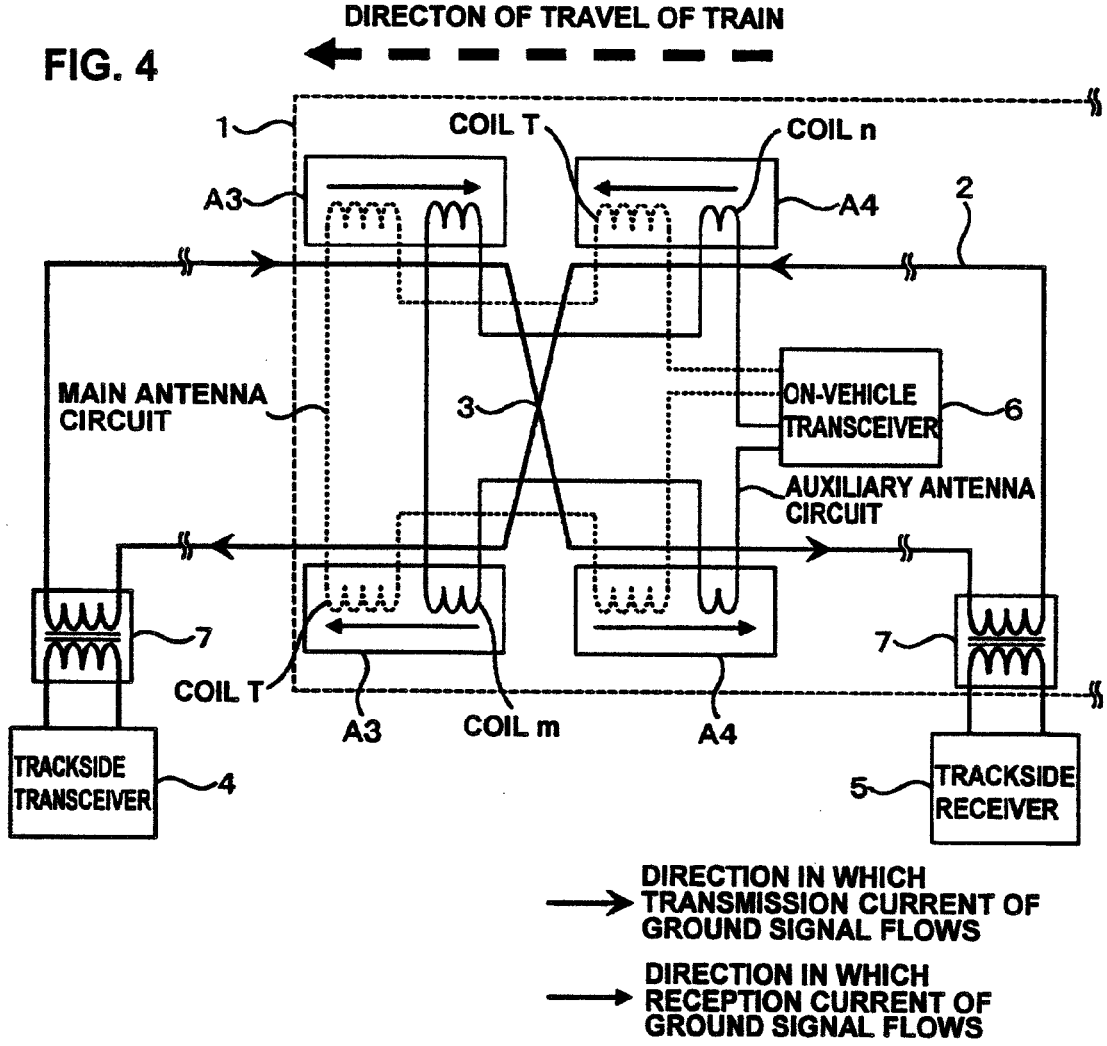
FIG. 4 is an explanatory view showing a fourth embodiment for carrying out the present invention.

FIG. 4 shows an arrangement and operation of an embodiment for carrying out the present invention.

Since the principle of operation of antennas A3 and A4 disposed on the train 1 for receiving ground signals is the same as the principle of operation of the antennas A3 and A4 for sending on-vehicle signals, only the operation of the antennas A3 and A4 for receiving ground signals will be described hereafter.

The antennas A3 shown in FIG. 4 have a coil T with T turns and a coil m with m turns mainly aimed at transmitting and receiving ground signals applied to the loop coils 2 and the on-vehicle signals output from the on-vehicle transceiver 6. Further, the antennas A4 have a coil T with T turns and a coil n having n turns mainly aimed at transmitting and receiving ground signals applied to the loop coils 2 and the on-vehicle signals output from the on-vehicle transceiver 6. The number of turns m and n of the auxiliary coils satisfy a relationship of m>n, for example.

In FIG. 4, antennas A3 are disposed on the front side in the direction of travel of the train 1, and antennas A4 are disposed on the rear side in the direction of travel of the train 1. The coils T of the antennas A3 and the coils T of the antennas A4 are respectively series-connected to add the levels and constitute a main antenna circuit. The main antenna circuit is connected to the on-vehicle transceiver 6. The coils m of the antennas A3 and the coils n of the antennas A4 are also respectively series-connected to add the levels and constitute an auxiliary antenna circuit. The auxiliary antenna circuit is also connected to the on-vehicle transceiver 6.

According to the present embodiment, the coils T disposed on antennas A3 and A4 have the same turns and have the same receiver sensitivity in both antennas A3 and A4 disposed on the front side and the rear side in the direction of travel of the train 1, but since the turns of coils m of the antennas A3 is greater than the turns of coils n of the antenna A4, the receiver sensitivity of the antenna A3 becomes higher.

Now, we will describe the operation for receiving ground signals when the train 1 stops so that the cross point 3 of the loop coil 2 is positioned between the antennas A3 disposed on the front side in the direction of travel of the train 1 and the antennas A4 disposed on the rear side in the direction of travel of the train 1.

When the train stops so that cross point 3 of the loop coil 2 is positioned between the antennas A3 disposed on the front side in the direction of travel of the train 1 and the antennas A4 disposed on the rear side in the direction of travel of the train 1, the current component of the ground signals flowing in the loop coil 2 opposed to the antennas A3 will be of reverse phase with the current component of the ground signals flowing in the loop coil 2 opposed to the antennas A4. Since the directions of flow of the current components of the ground signals are reversed, the current component of the ground signals induced to the antennas A3 will be of reverse phase with the current component of the ground signals induced to the antennas A4. Since the respective antennas A3 and A4 are series-connected to add the levels, the ground signals received via the antennas A3 and the ground signals received via the antennas A4 are cancelled out.

In the main antenna circuit, the coils T mainly aimed at transmitting and receiving ground signals and on-vehicle signals have the same receiver sensitivity in both the antennas A3 and antennas A4, so that the ground signals received via coil T in the antennas A3 and the ground signals received via coil T in the antennas A4 are cancelled out, and the ground signals will not be transmitted via the main antenna circuit to the on-vehicle transceiver 6.

However, in the auxiliary antenna circuit, the turns m of the coils m in the antennas A3 are greater than the turns n of coils n in the antennas A4, so that the ground signals received via coils m of the antennas A3 become greater than the ground signals received via coils n of the antennas A4, and the ground signals received via coils m disposed in the antennas A3 with higher level remain without being cancelled out, and will be transmitted via the auxiliary antenna circuit to the on-vehicle transceiver 6.

When the reception level of ground signals transmitted to the on-vehicle transceiver 6 from the main antenna circuit mainly aimed at transmitting and receiving ground signals and on-vehicle signals becomes equal to or smaller than a predetermined value, the control system confirms the ground signals received via the auxiliary antenna circuit by the on-vehicle transceiver 6 and utilizes the same for train control, so that the signals transmitted between the ground and the train can be prevented from being discontinued even when the train 1 stops with the cross point 3 positioned between the antennas A3 disposed on the front side in the direction of travel of the train 1 and the antennas A4 disposed on the rear side in the direction of travel of the train 1.

When it is assumed that the level of the ground signals received via coils T of the antennas A3 is "$I_T$", the level of the ground signals received via coils T of the antennas A4 also is "$I_T$". When the train 1 stops so that the cross point 3 of the loop coil 2 is positioned between antennas A3 and antennas A4, the current component of the ground signals induced to the coils T disposed on the antennas A4 will be of reverse phase with the flow of the current component of the ground signals induced to the coils T disposed on the antennas A3, so that the level becomes "$-I_T$". In the main antenna circuit, the respective antennas A3 and A4 are series-connected to add the levels, so that the on-board transceiver 6 receives "$_{IT}$"+"$-I_T$"="0" via the main antenna circuit, in other words, no ground signals are transmitted thereto.

When it is assumed under the same conditions as the above description that the level of the ground signals received via the coils m disposed in the antennas A3 is "$I_m$" and the level of the ground signals received via the coils n disposed in the antennas A4 is "$I_n$", the flow of the current component of ground signals induced to the coils n in the antennas A4 will be of reverse phase with the flow of current component of ground signals induced to the coils m of antennas A3, so that the level becomes "$-I_n$". Since the respective antennas A3 and A4 are series-connected to add the levels in the auxiliary antenna circuit, the on-vehicle transceiver 6 receives transmission of "$I_m$"+"$-I_n$"="$I_m-I_n$" ground signals via the auxiliary antenna circuit. Since the turns of the coils m disposed in the antennas A3 is greater than the turns of the coils n disposed in the antennas A4, the relationship of reception levels "$I_m$" and "$I_n$" of the ground signals satisfies "$I_m$">"$I_n$". Therefore, the ground signals transmitted via the auxiliary antenna circuit to the on-vehicle transceiver 6 will not become "0". Further, the ground signals "$I_M-I_N$" transmitted via the auxiliary antenna circuit to the on-vehicle transceiver 6 is set to a level high enough to enable train control.

It is assumed in the present embodiment that the receiver sensitivity of the coils m disposed in the antennas A3 is higher than the receiver sensitivity of the coils n disposed in the antennas A4, but even if the receiver sensitivity of the coils n disposed in the antennas A4 is set to be higher than the receiver sensitivity of the coils m disposed in the antennas A3, the ground signals transmitted to the on-vehicle transceiver 6 via the auxiliary antenna circuit will not become "0".

Further according to the present description, the coils m and the coils n disposed in the antennas are series-connected to add the levels, but even if the antennas are connected to subtract the levels and a difference of levels is provided to the ground signals received via the coils m disposed in the antennas A3 and the ground signals received via the coils n disposed in the antennas A4, the ground signals transmitted to the on-vehicle transceiver 6 will not become "0".

The present embodiment adopts an arrangement in which the antennas A3 and A4 disposed in the front side and the rear side in the direction of travel of the train 1 have an auxiliary antenna circuit in which coils with different signal receiver sensitivities are connected, so that when the reception level from the main antenna circuit connecting coils disposed in antennas A3 and A4 fall below a predetermined level, the signals received via the auxiliary antenna circuit is confirmed. Thus, the on-vehicle transceiver 6 constantly receives ground signals from either the main antenna circuit or the auxiliary antenna circuit. In other words, the present embodiment enables to continue transmission and reception of signals between the ground and the train in a stable manner without having to switch polarities of the antenna in response to the contact point on the circuit as taught in patent document 1.

Further, by adopting an arrangement as in the present embodiment in which the receiver sensitivity of the antennas A3 disposed on the front side in the direction of travel of the train 1 is higher than the receiver sensitivity of the antennas A4 disposed on the rear side in the direction of travel of the train 1, the ground signals applied to the loop coil 2 disposed on the front side in the direction of travel of the train can be received even when the train 1 stops with the boundary between two loop coils 2 to which ground signals having the same frequency and the same level are applied positioned between the antennas A3 and antennas A4, and the train control can be continued in a stable manner.

[Embodiment 5]

Figure 5:
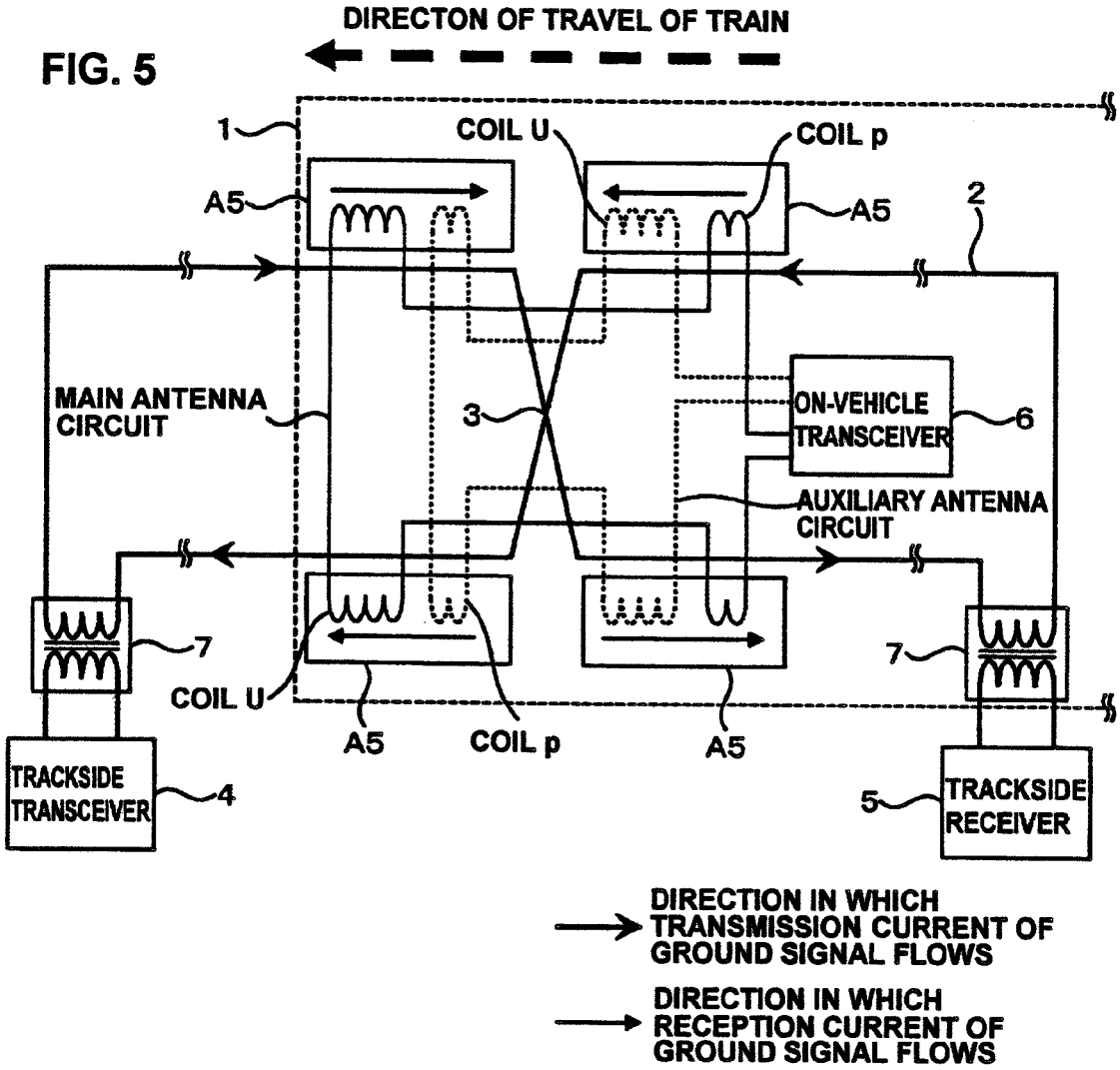
FIG. 5 is an explanatory view showing a fifth embodiment for carrying out the present invention.

FIG. 5 shows an arrangement and operation of an embodiment for carrying out the present invention.

Since the principle of operation of antennas A5 disposed on the train 1 for receiving ground signals is the same as the principle of operation of the antennas A5 for sending on-vehicle signals, only the operation of the antennas A5 for receiving ground signals will be described.

The antennas A5 shown in FIG. 5 has coils U with U turns and coils p with p turns. The turns U and p satisfy a relationship of U>p, for example.

In FIG. 5, four antennas A5 are disposed on the train 1, wherein the coils U of the antennas A5 disposed on the front side in the direction of travel of the train 1 and the coils p of the antennas A5 disposed on the rear side in the direction of travel of the train 1 are respectively series-connected to add the levels and constitute a main antenna circuit connected to the on-vehicle transceiver 6, and the coils p of the antennas A5 disposed on the front side in the direction of travel of the train 1 and the coils U of the antennas A5 disposed on the rear side in the direction of travel of the train 1 are also respectively series-connected to add the levels and constitute an auxiliary antenna circuit connected to the on-vehicle transceiver 6.

In the present arrangement, all the four antennas A5 disposed on the train 1 are identical, but by forming the main antenna circuit by series-connecting the coils U of the antennas A5 disposed on the front side in the direction of travel of the train 1 with the coils p of the antennas A5 disposed on the rear side in the direction of travel of the train to add the levels, the transmission sensitivity of the antennas A5 disposed on the front side in the direction of travel of the train 1 becomes higher than the transmission sensitivity of the antennas A5 disposed on the rear side in the direction of travel of the train 1.

Now, we will describe the operation for receiving ground signals when the train 1 stops so that the cross point 3 of the loop coil 2 is positioned between the antennas A5 disposed on the front side in the direction of travel of the train 1 and the antennas A5 disposed on the rear side in the direction of travel of the train 1.

When the train 1 stops so that the cross point 3 of the loop coil 2 is positioned between the two antennas A5 disposed on the front side in the direction of travel of the train 1 and the two antennas A5 disposed on the rear side in the direction of travel of the train 1, the current component of the ground signals flowing in the loop coil 2 opposed to the two antennas A5 disposed on the front side in the direction of travel of the train 1 will be of reverse phase with the current component of the ground signals flowing in the loop coil 2 opposed to the antennas A5 disposed on the rear side in the direction of travel of the train 1. Since the directions in which the current components of the ground signals flow are reversed, the current component of the ground signals induced to the antennas A5 disposed on the front side in the direction of travel of the train 1 is of reverse phase with the current component of the ground signals induced to the antennas A5 disposed on the rear side in the direction of travel of the train 1. Since the respective antennas A5 are series-connected to add the levels, the ground signals received via the antennas A5 disposed on the front side in the direction of travel of the train 1 and the ground signals received via the antennas A5 disposed on the rear side in the direction of travel of the train 1 are cancelled out.

However, in the main antenna circuit, since the turns U of the coils U in the antennas A5 disposed on the front side in the direction of travel of the train 1 are greater than the turns p of coils p in the antennas A5 disposed on the rear side in the direction of travel of the train 1, the ground signals received via the antennas A5 disposed on the front side in the direction of travel of the train 1 become greater than the ground signals received via the antennas A5 disposed on the rear side in the direction of travel of the train 1, so that the ground signals having a higher level received via the antennas A5 disposed on the front side in the direction of travel of the train 1 will remain without being cancelled out even when the current component of the ground signals induced to the antennas A5 disposed on the front side in the direction of travel of the train 1 is of reverse phase with the current component of the ground signals induced to the antennas A5 disposed on the rear side in the direction of travel of the train 1, and will be transmitted to the on-vehicle transceiver 6.

When it is assumed in the main antenna circuit that the level of the ground signals received via the coils U in the antennas A5 disposed on the front side in the direction of travel of the train 1 is "$I_U$" and the level of the ground signals received via the coils p in the antennas A5 disposed on the rear side in the direction of travel of the train 1 is "$I_p$", the flow of the current component of ground signals induced to the coils p in the antennas A5 disposed on the rear side in the direction of travel of the train 1 is of reverse phase with the flow of current component of ground signals induced to the coils U of antennas A5 disposed on the front side in the direction of travel of the train 1, so that the level thereof will be "$-I_p$". Since the coils U of the antennas A5 and the coils p of the antennas A4 are series-connected to add the levels, the on-vehicle transceiver 6 receives transmission of "$I_U$"+"$-I_p$"="$I_U-I_p$" ground signals via the main antenna circuit. Since the number of turns of the coils U in the antennas A5 disposed on the front side in the direction of travel of the train 1 is greater than the number of turns of the coils p in the antennas A5 disposed on the rear side in the direction of travel of the train 1, the relationship of reception levels "$I_U$" and "$I_p$" of the ground signals satisfies "$I_U$">"$I_p$". Therefore, the ground signals transmitted via the main antenna circuit to the on-vehicle transceiver 6 will not become "0".

It is assumed in the present embodiment that the receiver sensitivity of the antennas A5 disposed on the front side in the direction of travel of the train 1 is higher than the receiver sensitivity of the antennas A5 disposed on the rear side in the direction of travel of the train 1, but even if the receiver sensitivity of the antennas A5 disposed on the rear side in the direction of travel of the train 1 is set to be higher than the receiver sensitivity of the antennas A5 disposed on the front side in the direction of travel of the train 1, the ground signals transmitted to the on-vehicle transceiver 6 will not become "0". Therefore, the present embodiment enables to continue transmission and reception of signals between the ground and the train in a stable manner without having to switch polarities of the antenna in response to the contact point on the circuit as taught in patent document 1.

Further according to the present description, the coils U in the antennas A5 disposed on the front side in the direction of travel of the train 1 and the coils p in the antennas A5 disposed on the rear side in the direction of travel of the train 1 are series-connected to add the levels, but even if the antennas are connected to subtract the levels and a difference in levels is provided to the ground signals received via the antennas A5 disposed on the front side in the direction of travel of the train 1 and the ground signals received via the antennas A5 disposed on the rear side in the direction of travel of the train 1, the ground signals transmitted to the on-vehicle transceiver 6 will not become "0".

The present embodiment adopts an arrangement in the main antenna circuit in which the receiver sensitivity of the antennas A5 disposed on the front side in the direction of travel of the train 1 is set to be higher than the receiver sensitivity of the antennas A5 disposed on the rear side in the direction of travel of the train 1, so that the ground signals applied to the loop coils 2 disposed on the front side in the direction of travel of the train 1 can be received constantly even when the train 1 stops so that the boundary between two loop coils 2 to which ground signals of the same frequency and the same level are applied is positioned between antennas A5 disposed on the front side in the direction of travel of the train 1 and the antennas A5 disposed on the rear side in the direction of travel of the train 1, thereby enabling train control to be continued in a more stable manner.

Moreover, in addition to the above-described embodiment, when the reception level of ground signals received via the main antenna circuit by the on-vehicle receiver 6 falls below a predetermined level due to some reasons, the control system can confirm via the on-vehicle transceiver 6 the ground signals received by the on-vehicle transceiver 6 through the auxiliary antenna circuit and utilize the same for train control. According to this system, the on-vehicle transceiver 6 will constantly receive ground signals either via the main antenna circuit or the auxiliary antenna circuit, so that the train control can be performed with even higher stability.

Further, if the main antenna circuit is designed so that the antennas A5 disposed on the front side has higher receiver sensitivity than those disposed on the rear side, and the auxiliary antenna circuit is designed so that the antennas A5 disposed on the rear side has higher receiver sensitivity than those disposed on the front side, it becomes possible to prevent reception levels of both the main antenna circuit and the auxiliary antenna circuit from being simultaneously deteriorated even if the reception level of ground signals received via the main antenna circuit by the on-vehicle transceiver 6 is smaller than a predetermined level, since the auxiliary antenna circuit constantly receives signals under a condition different from that of the main antenna circuit. Therefore, the train control can be continued with even higher stability.

The present embodiment adopts an arrangement in which the receiver sensitivities of front and rear antennas are differentiated between the main antenna circuit and the auxiliary antenna circuit, but the receiver sensitivity between front and rear antennas of the auxiliary antenna circuit can be the same. In such arrangement, since the auxiliary antenna circuit receives signals constantly under conditions different from the main antenna circuit, it becomes possible to avoid the reception levels of both the main antenna circuit and the auxiliary antenna circuit from being simultaneously reduced.

[Embodiment 6]

Figure 6:
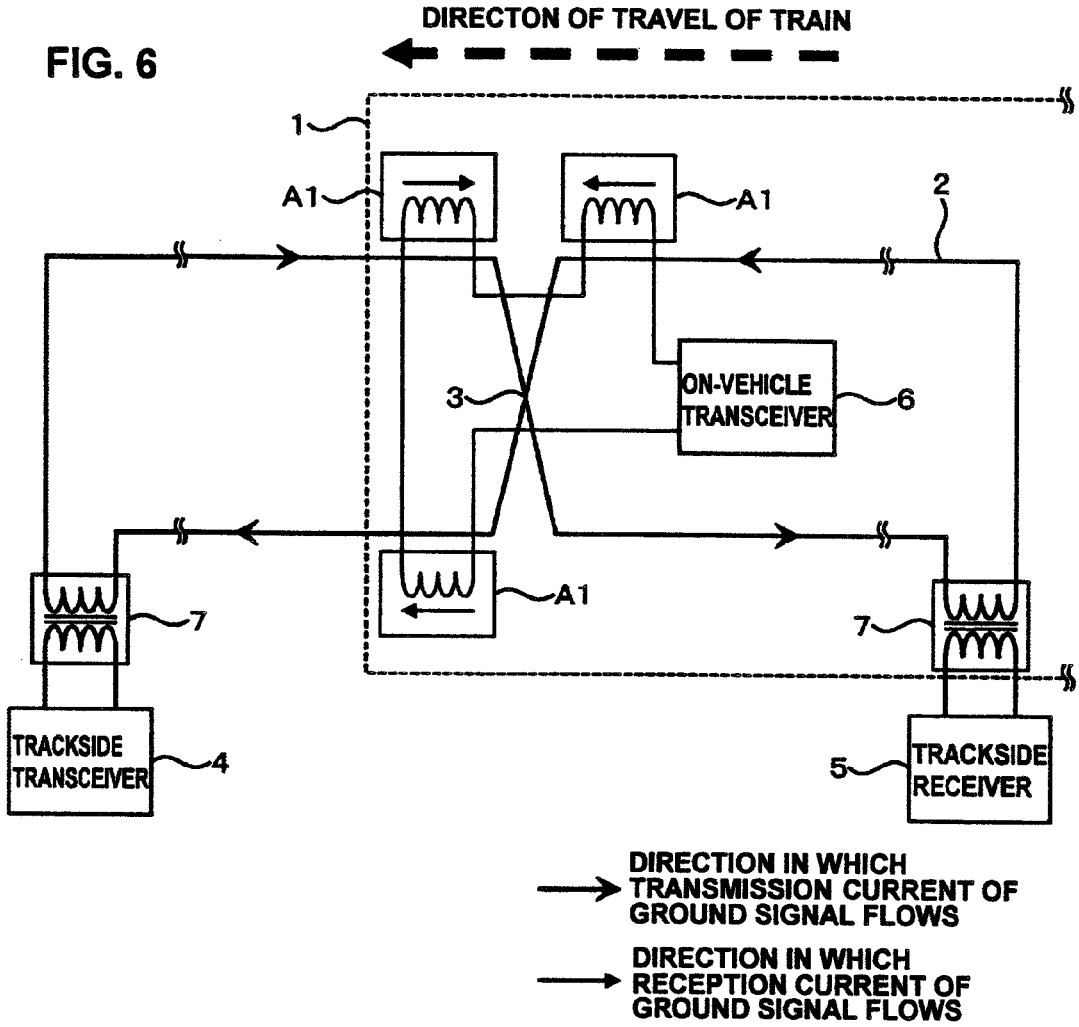
FIG. 6 is an explanatory view showing a sixth embodiment for carrying out the present invention.

FIG. 6 shows an arrangement and operation of an embodiment for carrying out the present invention.

Since the principle of operation of antennas A1 disposed on the train 1 for receiving ground signals is the same as the principle of operation of the antennas A1 for sending on-vehicle signals, only the operation of the antennas A1 for receiving ground signals will be described.

FIG. 6 is an embodiment in which two antennas A1 having coils with M turns are disposed on the front side in the direction of travel of the train 1 and one antenna A1 is disposed on the rear side in the direction of travel of the train 1, wherein the respective antennas A1 are series-connected to add the levels.

Now, we will describe the operation for receiving ground signals when the train 1 stops so that the cross point 3 of the loop coil 2 is positioned between the antennas A1 disposed on the front side in the direction of travel of the train 1 and the antenna A1 disposed on the rear side in the direction of travel of the train 1.

When the train stops so that the cross point 3 of the loop coil 2 is positioned between the antennas A1 disposed on the front side in the direction of travel of the train 1 and the antenna A1 disposed on the rear side in the direction of travel of the train 1, the current component of the ground signals flowing in the loop coil 2 opposed to the antennas A1 disposed on the front side in the direction of travel of the train 1 will be of reverse phase with the current component of the ground signals flowing in the loop coil 2 opposed to the antenna A1 disposed on the rear side in the direction of travel of the train 1. Since the directions in which the current components of the ground signals flow are reversed, the current component of the ground signals induced to the antennas A1 disposed on the front side in the direction of travel of the train 1 is of reverse phase with the current component of the ground signals induced to the antenna A1 disposed on the rear side in the direction of travel of the train 1. Since the respective antennas A1 are series-connected to add the levels, the ground signals received via the antennas A1 disposed on the front side in the direction of travel of the train 1 and the ground signals received via the antenna A1 disposed on the rear side in the direction of travel of the train 1 are cancelled out.

However, since the number of antennas A1 disposed on the front side in the direction of travel of the train 1 is double the number of the antenna A1 disposed on the rear side in the direction of travel of the train 1, the ground signals received via the two antennas A1 disposed on the front side in the direction of travel of the train 1 will be double the ground signals received via the single antenna A1 disposed on the rear side in the direction of travel of the train 1. Thus, even if the current component of ground signals induced to the antennas A1 disposed on the front side in the direction of travel of the train 1 is of reverse phase with the current component of ground coils induced to the antenna A1 disposed on the rear side in the direction of travel of the train 1, the ground signals received via antennas A1 disposed on the front side in the direction of travel of the train 1 will remain without being cancelled, and are transmitted to the on-vehicle transceiver 6.

When it is assumed that the level of ground signals received via two antennas A1 disposed on the front side in the direction of travel of the train 1 is "$I_M$", the level of ground signals received via the single antenna A1 disposed on the rear side in the direction of travel of the train 1 will be half, and the flow of the current component of the ground signals induced thereto will be of reverse phase with the flow of the current component of ground signals induced to antennas A1 disposed on the front side in the direction of travel of the train 1, so that the level becomes "$-0.5\ I_M$". Since the respective antennas A1 are series-connected to add the levels, the on-vehicle transceiver 6 receives transmission of ground signals of "$I_M$"+"$-0.5\ I_M$"="$0.5\ I_M$". Thus, the ground signals transmitted to the on-vehicle transceiver 6 will not become "0".

In the present embodiment, since the number of antennas A1 disposed on the front side in the direction of travel of the train 1 is set to two and the number of the antenna A1 disposed on the rear side in the direction of travel of the train 1 is set to one, the receiver sensitivity of the antennas disposed on the front side in the direction of travel of the train 1 becomes higher, but also by setting the number of antennas A1 disposed on the rear side in the direction of travel of the train 1 to be greater than the number of antennas A1 disposed on the front side in the direction of travel of the train 1 so as to enhance the receiver sensitivity of the antennas A1 disposed on the rear side in the direction of travel of the train than the receiver sensitivity of the antenna A1 disposed on the front side, it becomes possible to prevent ground signals transmitted to the on-vehicle transceiver 6 from becoming "0". Thus, the present embodiment enables to continue transmission and reception of signals between the ground and the train in a stable manner without having to switch polarities of the antenna in response to the contact point on the circuit, as taught in patent document 1.

Further, regardless of the number of antennas being disposed, it becomes possible to prevent the ground signals transmitted to the on-vehicle transceiver 6 from becoming "0" if a difference in levels is provided to the ground signals received via the antennas A1 disposed on the front side in the direction of travel of the train 1 and the ground signals received via the antenna A1 disposed on the rear side in the direction of travel of the train 1.

According the present embodiment, the antennas A1 disposed on the front side in the direction of travel of the train 1 and the antenna A1 disposed on the rear side in the direction of travel of the train 1 are series-connected to add the levels, but it is also possible to prevent the ground signals transmitted to the on-vehicle transceiver 6 from becoming "0" by connecting the antennas to subtract the levels and providing a difference in levels of ground signals received by the antennas A1 disposed on the front side in the direction of travel of the train 1 and ground signals received by the antenna A1 disposed on the rear side in the direction of travel of the train 1.

By adopting the present arrangement in which the receiver sensitivity of the antennas A1 disposed on the front side in the direction of travel of the train 1 is higher than the receiver sensitivity of the antenna A1 disposed on the rear side in the direction of travel of the train 1, the ground signals applied to the loop coils 2 disposed on the front side in the direction of travel of the train 1 can be received constantly even when the train 1 stops so that the boundary between two loop coils 2 to which ground signals having the same frequency and the same level are applied is positioned between the antennas A1 disposed on the front side in the direction of travel of the train 1 and the antenna A1 disposed on the rear side in the direction of travel of the train 1, so that the train control can be continued in a more stable manner.

In the above-mentioned embodiments 2, 3, 4 and 5, the turns of coils were increased as a method for enhancing the antenna sensitivity, but other methods such as increasing the core diameter of the antennas can be adopted. Further, the antenna sensitivity can also be improved by changing the materials of the core. Even further, the antenna sensitivity can be improved by increasing the thickness of the coils. In other words, the antenna sensitivity can be improved by increasing the inductance.

In the above-mentioned embodiments, independent antennas are disposed on the front and rear sides in the direction of travel of the train 1, but it is also possible to form independent antennas by winding coils on both ends of a single core. Even when the core is used in common, when the coils are wound collectively on both ends, the coils can be considered as two independent antennas.

The above-mentioned embodiments were described taking a straddle-beam monorail as an example, but the present invention is not restricted to straddle-beam monorails, and the present invention can be applied to other types of monorails such as suspended monorails.

What is claimed is:

1. A signal system on a railway vehicle comprising:

an on-vehicle receiver for receiving ground signals used for controlling the railway vehicle from a loop coil disposed on a track on the ground;

a first antenna for receiving ground signals from the loop coil; and a second antenna disposed rearward from the first antenna in a direction of travel of the railway vehicle for receiving ground signals from the loop coil;

wherein the first antenna and the second antenna are mutually connected to transmit the ground signals to the on-vehicle receiver;

the first antenna has a receiver sensitivity for receiving signals from the loop coil that differs from the second antenna;

turns of coil of the first antenna and turns of coil of the second antenna are different so as to differentiate a signal level of the ground signals received from the first antenna and the signal level of the ground signals received from the second antenna;

the first antenna and the second antenna are series-connected and connected with the on-vehicle receiver; and a difference between a signal level received via the first antenna and a signal level received via the second antenna satisfies a signal level capable of performing control of the railway vehicle.

2. The signal system on a railway vehicle according to claim 1, wherein a coil of the first antenna has greater turns than a coil of the second antenna, and a receiving sensitivity of the first antenna is higher than that of the second antenna.

3. The signal system on a railway vehicle according to claim 1, wherein at least either the first antenna or the second antenna is composed of a plurality of antennas; and the first antenna and the second antenna have a different number of antennas.

4. A signal system on a railway vehicle comprising:

an on-vehicle receiver for receiving ground signals used for controlling the railway vehicle from a loop coil disposed on a track on the ground;

a first antenna for receiving ground signals from the loop coil and transmitting the ground signals to the on-vehicle receiver; and a second antenna disposed rearward from the first antenna in a direction of travel of the railway vehicle for receiving ground signals from the loop coil and transmitting the ground signals to the on-vehicle receiver;

wherein the on-vehicle receiver performs processes to change a signal level of the ground signals received from the first antenna or the second antenna so as to differentiate the signal level of the ground signals received from the first antenna and the signal level of the ground signals received from the second antenna, and to add the ground signals received from the first antenna and the second antenna; and a difference between a signal level received via the first antenna and a signal level received via the second antenna satisfies a signal level capable of performing control of the railway vehicle.

5. A signal system on a railway vehicle comprising:

an on-vehicle receiver for receiving ground signals used for controlling the railway vehicle from a loop coil disposed on a track on the ground;

a first antenna for receiving ground signals from the loop coil; and a second antenna disposed rearward from the first antenna in a direction of travel of the railway vehicle for receiving ground signals from the loop coil;

wherein the first antenna and the second antenna are equipped with two or more coils;

wherein the system further includes a first circuit in which one coil of the first antenna is connected with one coil of the second antenna;

a second circuit in which the other coil of the first antenna is connected with the other coil of the second antenna;

wherein the respective coils of the first antenna and the second antenna have different receiver sensitivities in at least either the first circuit or the second circuit; and the on-vehicle receiver selects the ground signals used for controlling the vehicle between the ground signals received via the first circuit or the ground signals received via the second circuit.

6. The signal system on a railway vehicle according to claim 1, wherein the on-vehicle receiver transmits on-vehicle signals via the first antenna and the second antenna to the loop coil.

7. A railway transportation system comprising:

the signal system on the railway vehicle according to claim 1;

the loop coil to which ground signals from a trackside transceiver are applied; and a trackside equipment in which the loop coil is disposed.

8. A railway transportation system comprising:

the signal system on the railway vehicle according to claim 4;

the loop coil to which ground signals from a trackside transceiver are applied; and a trackside equipment in which the loop coil is disposed.

9. A railway transportation system comprising:

the signal system on the railway vehicle according to claim 5;

the loop coil to which ground signals from a trackside transceiver are applied; and a trackside equipment in which the loop coil is disposed.

* * * * *